US006502780B2

(12) United States Patent
Harris et al.

(10) Patent No.: US 6,502,780 B2
(45) Date of Patent: Jan. 7, 2003

(54) APPARATUS PROVIDING A POINT OF SALE PRINTER WITH A LARGE PAPER SUPPLY ROLL HAVING CONTROLLED ACCELERATION AND DECELERATION

(75) Inventors: Richard Hunter Harris, Raleigh, NC (US); Robert Andrew Myers, Cary, NC (US); Timothy Doyle Peele, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/797,223

(22) Filed: Mar. 1, 2001

(65) Prior Publication Data

US 2002/0121569 A1 Sep. 5, 2002

(51) Int. Cl.[7] ..... B65H 20/32; B65H 23/18

(52) U.S. Cl. ..... 242/417.3; 242/417; 242/422.6; 242/422.7; 242/562.1; 242/559.4

(58) Field of Search ..... 242/417.3, 422.6, 242/422.7, 559.4, 399.1, 562.1, 566; 226/11, 38

(56) References Cited

U.S. PATENT DOCUMENTS

| | | | | |
|---|---|---|---|---|
| 1,625,190 A | | 4/1927 | Boynton | |
| 2,555,885 A | | 6/1951 | Hope | 242/55.2 |
| 4,452,403 A | | 6/1984 | Arronte | 242/55.2 |
| 4,614,312 A | | 9/1986 | Del Pino | 242/55.2 |
| 4,808,800 A | | 2/1989 | Nishijima et al. | 235/58 CF |
| 4,821,974 A | | 4/1989 | Poehlein | 242/68.4 |
| 5,060,877 A | | 10/1991 | Bullivant | 242/55 |
| 5,228,633 A | | 7/1993 | Johnson, et al. | 242/55.53 |
| 5,825,374 A | * | 10/1998 | Albertalli et al. | 242/417.3 |
| 6,352,257 B1 | * | 3/2002 | Todaro et al. | 242/417.3 |

FOREIGN PATENT DOCUMENTS

JP 403172259 A * 7/1991

* cited by examiner

*Primary Examiner*—Donald P. Walsh
*Assistant Examiner*—Jonathan R Miller
(74) *Attorney, Agent, or Firm*—J. Bruce Schelkopf; Ronald V. Davidge

(57) ABSTRACT

A point of sale printer is provided with a large paper supply roll mounted externally from the printer. The printer includes a paper drive which rapidly accelerates and decelerates a paper web extending from the paper supply roll. A tensioning roll is moved in one direction to feed the web into the printer during the relatively slow acceleration of the paper supply roll and in an opposite direction to prevent a tangle of paper as the paper supply roll is decelerated after the printer stops moving the paper web. A cable assembly is provided to facilitate loading the large paper supply roll. A braking spring helps to decelerate the paper supply roll and further engages a flap formed in an outer end of the paper web to thread this end of the web into the printer.

20 Claims, 2 Drawing Sheets

APPARATUS PROVIDING A POINT OF SALE PRINTER WITH A LARGE PAPER SUPPLY ROLL HAVING CONTROLLED ACCELERATION AND DECELERATION

CROSS-REFERENCE TO A RELATED APPLICATION

This application is related to a U.S. Application, Ser. No. 09/797,094, filed on an even day herewith, entitled "Paper Roll Retention System for a Point of Sale Printer, having the same assignee as the present invention.

BACKGROUND INFORMATION

Field of Invention

This invention relates to a point of sale printer having a large paper roll supply, and, more particularly, to such a printer having a large supply paper roll mounted beneath a counter surface extending under the printer, and to apparatus for controlling the rotational acceleration and deceleration of a massive paper supply roll as movement of a paper web through the printer is suddenly started and stopped.

BACKGROUND ART

Point of sale printers have typically been used to print sales receipts. A recent trend in the use of such printers is an increased acceptance of thermal printing methods, which provide for operation at much faster printing speeds. The availability of faster printing speeds has led to including additional printed material on sales receipts. For example, many sales receipts now include store logos, advertisements, barcodes, and statements of store policy, especially regarding the return of purchased merchandise. Such additional printed material greatly increases the. length of typical receipts. While faster printing speeds allow the generation of such longer receipts without significantly slowing the checkout process, the increased length of receipts results in an increased frequency in which paper supply rolls must be changed.

A number of improvements have been made in the simplification of the process of loading new paper supply rolls, providing, for example, a "drop and load" feature for a point of sale terminal. An example of such an improvement is found in U.S. Pat. No. 5,060,877, which describes an automatic paperfeed apparatus including a receptacle for a paper roll. Within the receptacle, the paper roll rests upon a guide roll and a first feed roll which is capable of rotating the paper roll to feed a paper web from the roll. A guide chute is provided which guides movement of the paper web from the paper roll to an exit portion of the guide chute, from where it may be introduced into a printer or other device. The guide chute is comprised of a portion of the floor of the receptacle and a movable upper element. The movable upper element is pivotally mounted at one end on the shaft associated with the first feed roll. A second feed roll is positioned between the ends of the guide chute to drive the paper web through the guide chute, and cooperates with pressure rolls mounted on the upper element of the guide chute. A motor is provided for driving the first and second feed rolls.

While the time required to change paper supply rolls is certainly reduced by such improvements, a new paper supply roll must be found when it is needed, and the resulting process of changing rolls disrupts the process of checking out merchandise. Thus, what is needed is a way to provide significantly more paper in a single supply roll, so that the frequency of changing rolls is significantly reduced.

U.S. Pat. No. 4,808,800 describes apparatus for providing an additional and somewhat larger paper roll for an electronic printer calculator, which then contains rolls of paper outside and inside the calculator and a printer for printing out data on either of the rolls of paper. A passage for leading the roll paper set outside the calculator main body to the printer is separate from that for leading the roll paper set inside the calculator main body to the printer.

While the apparatus of U.S. Pat. No. 4,808,800 does provide for a somewhat larger roll of supply paper, what is needed is a much larger roll which is mounted in a location spaced away from the printing mechanism. Furthermore, what is needed is a method for dealing with the rotational inertia of a large roll of paper, both in terms of accelerating the roll to a peripheral speed sufficient to supply paper for a modem high-speed point of sale printer, and in terms of decelerating the roll when the printing process has been stopped without spooling off a substantial portion of the paper web.

SUMMARY OF THE INVENTION

Thus, it is a first objective of the present invention to provide a substantially larger paper supply roll for a point of sale terminal;

It is a second objective thereof to provide a means for rotationally accelerating a massive paper roll as a printer suddenly begins moving a paper web from the roll to print;

It is a third objective thereof to provide a means for minimizing the unspooling of a paper web during deceleration of a massive paper roll after a printer suddenly stops moving a paper web from the roll to print;

It is a fourth objective thereof to provide a means facilitating the loading of a massive paper roll into paper feed apparatus for a printer; and It is a fifth objective thereof to provide a means for retaining a paper web extending upward into a printer in position within a paper feed apparatus when an upper end of the paper web is released by a printer.

It is a sixth objective thereof to provide a means to facilitate threading a paper web from a paper supply roll under the counter into a printer on the counter.

According to a first aspect of the. present invention, paper supply apparatus is provided for a printer having a paper drive moving a paper web through the printer in a paper feeding direction. The paper supply apparatus includes a roll mounting bracket, a spindle, a tensioning roller, and a tensioning roller support structure. The roll mounting bracket is disposed externally from the printer. The spindle removably and rotatably mounts a paper supply roll in the roll mounting bracket. The tensioning roller applies a tensioning force to a portion of the paper web extending between the paper supply roll mounted on the spindle and the printer. The tensioning rollersupport structure constrains the tensioning roller to move along a preferred path, with the tensioning roller moving along the preferred path in a first direction as the paper roll is accelerated to rotate in an unspooling direction in response to the paper drive starting to move the paper web through the printer, and with the tensioning roller moving along the preferred path opposite the first direction as the paper roll is decelerated in response to the paper drive stopping movement of the paper web through the printer.

According to a second aspect of the present invention, paper supply roll mounting apparatus is provided for a printer having a paper drive moving a paper web from a paper supply roll through the printer in a paper feeding direction. The paper supply apparatus includes a roll mounting bracket, a spindle, and a cable extending on each side of the spindle. The roll mounting bracket is disposed externally from the printer. The spindle removably and rotatably mounts a paper supply roll in the roll mounting bracket and includes a shaft having a first pulley attached at a first end of the shaft and a second pulley removably attached at a second end of the shaft. The cable engages the first and second pulleys between an anchor point and a handle, with the spindle being movable into the slot at each side of the roll mounting bracket while the spindle is held in suspension by the cable.

DESCRIPTION OF THE INVENTION

Figure 1:
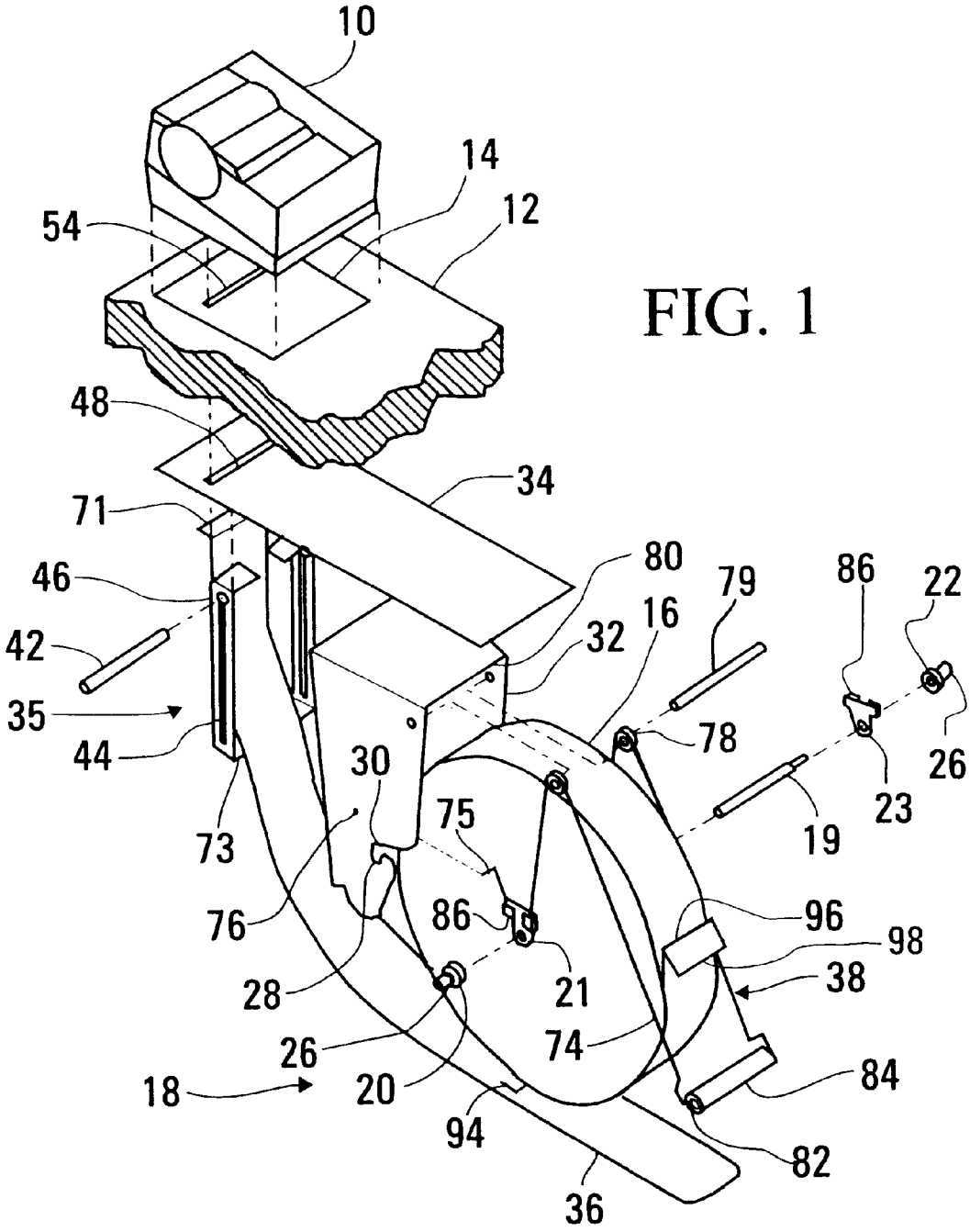
FIG. 1 is an isometric view of various components of a point of sale printer having a large paper supply roll, built in accordance with the present invention, in an exploded relationship with one another.

Referring to FIG. 1, a point of sale printer 10 is mounted atop a counter 12 by means of a printer mounting plate 14. The point of sale printer 10 is, for example, an IBM 4610-TM6 thermal printer, which prints at a paper speed of approximately 16.5 cm/sec (6.5 in/sec). In accordance with the present invention, the printer 10 draws a paper web from a large roll 16, rotatably mounted beneath the counter 12, within paper supply apparatus generally indicated as 18. The large paper roll 16 has a diameter as large as 38 cm (15 in.), holding about 25 times as much paper as a conventional paper roll for a point of sale printer.

A spindle assembly, including a shaft 19, a first spindle pulley 20 pressed onto the shaft 19, and a first cable guide 21, is slid into a central hole (not shown) within the large paper roll 16. The large paper roll 16 is further held in place on the spindle assembly by means of a second pulley 22, which is snapped into a detent surface (not shown) on the shaft 19, along with a second cable guide 23. When the large paper roll 16 is fully installed within the apparatus of FIG. 1, the cylindrical hubs 26 of the pulleys 20, 22 extend through end portions 28 of slots 30 within a roll mounting bracket 32. The roll mounting bracket 32 is fastened to a bracket mounting plate 34 to extend downward when the bracket mounting plate 34 is mounted to a lower surface of the counter 12. In this way paper roll 16 is mounted to rotate about its center within the roll mounting bracket 32.

The paper supply apparatus 18 also includes a web tensioning device, generally indicated as 35, a braking spring 36, and a paper loading cable assembly 38.

Figure 2:
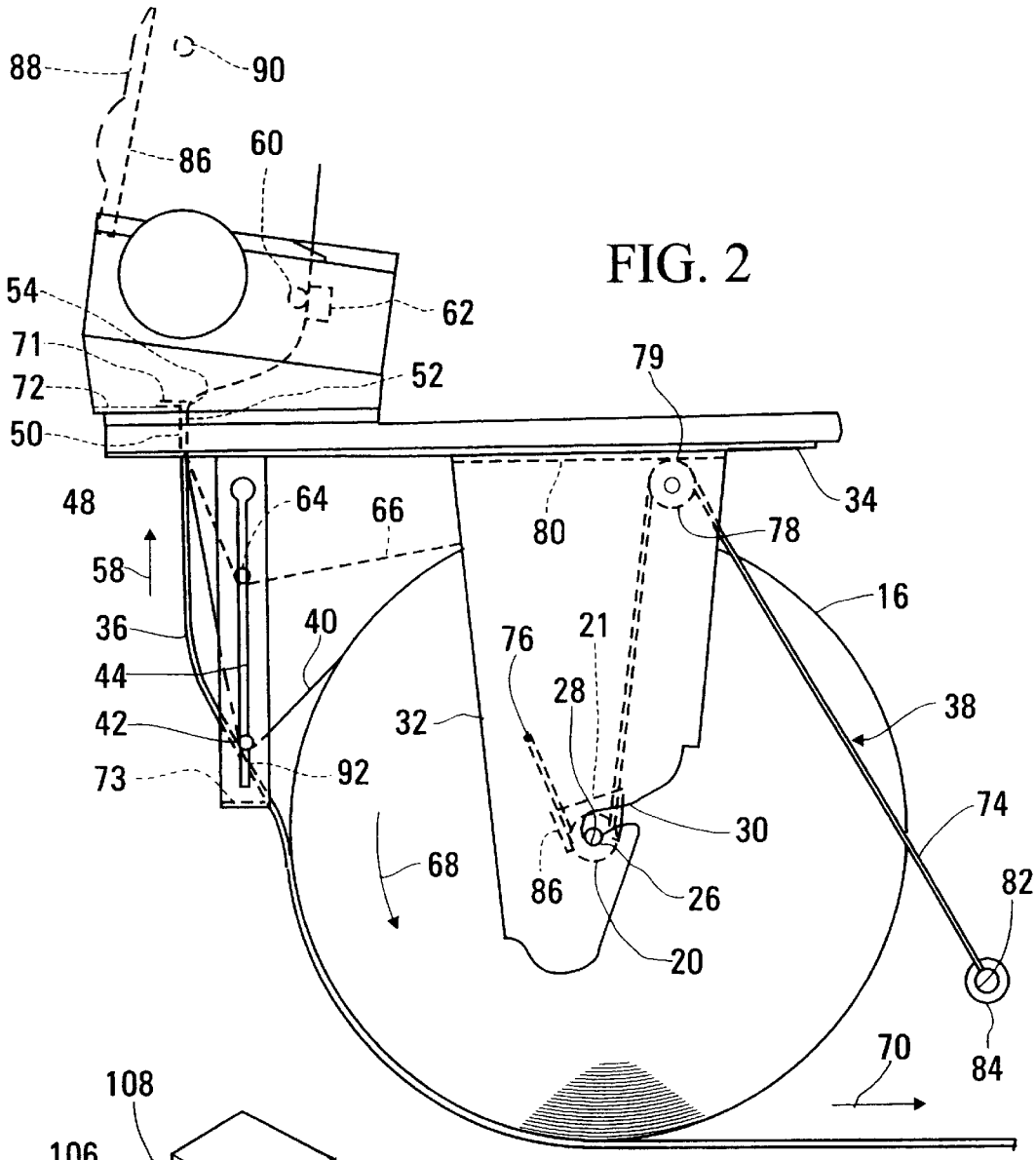
FIG. 2 is an elevation of the point of sale printer of FIG. 1.

Continuing to refer to FIG. 1, and additionally referring to FIG. 2, a paper web 40, pulled from the large paper roll 16 extends under a tensioning roller 42, which is mounted to slide and rotate within a vertical slot 44 in a tensioning bracket 46, forming the web tensioning device 35. The paper web 40 extends upward through a slot 48 in the bracket mounting plate 34, a slot 50 in the counter 12, a slot 52 in the printer mounting plate 14 and a slot 54 in the base of the printer 10.

The printing process is typically begun with the paper web 40 and the tensioning roller 42 in the positions shown in FIG. 2. Movement of the paper web 40 through the printer 10, upward in the direction of arrow 58, is controlled by a drive roll 60, which is rotationally driven to move the paper web 40 against a thermal print head 62. The thermal print head 62 includes a number of heating elements which are turned on and off to produce visible markings on a thermally sensitive surface of the paper web 40. In this way, the paper web 40 is very rapidly accelerated to a printing speed of, for example, 16.5 cm/sec (6.5 in/sec). The rotational moment of inertia of the large paper roll 16 prevents its rapid acceleration to a rotational. speed allowing the paper web 40 to be pulled from the roll 16 at the such a speed. Instead, the tensioning roller 42 is initially pulled upward, toward the position indicated by a dashed line 64, as the paper web is moved into the configuration indicated by dashed lines 66. Upward movement of the tensioning roller 42 allows the paper web 40 to be pulled upward into the printer without a corresponding rotation of the large paper roll 16. However, the weight of the tensioning roller 42 causes a torque to be applied to large paper roll 16 through the paper web extending between the tensioning roller 42 and the paper roll 16, so that the paper roll 16 is accelerated in the paper unspooling direction of arrow 68. The tensioning roller 42 continues downward as the paper supply roll 16 is brought up to a peripheral speed matching the speed at which the paper web 40 is moved through the printer 10. When these speeds match, the drive roll 60 within the printer 10 continues to pull paper with the paper roll 16 turning at a constant speed, and with the tensioning roller rotating at a constant elevation, generally between the position in which it is shown in FIG. 2 and its uppermost position, indicated by dashed lines 64. During this portion of the printing operation, the drive roll 60 easily overcomes friction within the paper supply apparatus 18, without a need to overcome the inertia of the large paper roll 16.

When the printer 10 finishes a printing operation, the drive roll 60 abruptly stops, terminating movement of the paper web 40 into the printer 10. The paper roll 16 begins to decelerate, primarily due to friction between its periphery and the braking spring 36. This friction limits the additional rotation of the paper roll. 16, after the drive roll 60 within the printer is stopped. Without this limitation, the rotational energy stored within the paper roll 16 would cause enough continued rotation of the paper roll 16 to unspool a significant length of the paper web 40, which could otherwise become tangled within the paper feed apparatus 18 due to a lack of control of its configuration. As the paper web 40 is unspooled with the drive roll 60 stopped, the tensioning roller 42 moves downward into its lowest position, in which it is shown in FIG. 2.

Thus, the tensioning device 35 and the braking spring 36 provide a buffer between the need of the printer 10 to start and stop the movement of paper therethrough very rapidly and the need of the massive paper roll 16 to accelerate and decelerate rotationally relatively smoothly and slowly.

The braking spring 36 is formed as a cantilever spring extending downward, opposite the direction of arrow 58, through an aligned series of slots 48, 50, 52, 54 and rightward, in the direction of arrow 70. The braking spring 36 is held in place by a tab 71 extending along an internal surface 72 of the printer 10, with the braking spring 36 being deflected by the peripheral surface of the large paper roll 16 when this roll 16 is installed in the paper supply apparatus 18, and to move upward as the paper roll 16 is reduced in diameter with the usage of paper. The braking spring 36 is also supported by resting against a central segment 73 of the tensioning bracket 46. The braking spring 36 exerts less force on the peripheral surface of the paper roll 16 as this roll is reduced in diameter with paper usage, but less frictional force is required to stop the smaller roll properly, without spooling off too much paper during deceleration. Before all of the paper is used, the paper roll 16 may become small enough to move out of contact with the braking spring 36, but a roll this small does not require the braking spring 36 to stop properly.

The paper loading cable assembly 38 is used to facilitate loading the paper roll 16, which weighs about 6.8 Kg (15 lb.), into the paper feed apparatus 18. The cable assembly 38 includes a flexible cable 74 having ends 75 anchored at holes 76 on 10 opposite sides of the roll mounting bracket 32. The flexible cable 74 extends over pulleys 78, which are rotatably mounted on the roll mounting bracket 32 close enough to its central section 80 to entrap the cable 74 in the flanged periphery of the pulleys 78, while allowing rotation of the pulleys 78. During the process of assembling the paper supply apparatus 18, the pulleys 78 are pressed on a shaft 79 to turn together. The flexible cable 74 also extends through a hole 82 of a handle 84 and within cable guiding slots 86 of the cable guides 21, 23.

The paper roll 16 is assembled onto the paper loading cable assembly 38 by inserting a spindle assembly including the shaft 19, the first spindle pulley 20, and the first cable guide 21, into the central hole (not shown) within the paper supply roll 16. A second assembly, including the second spindle pulley 22 and the second cable guide 23, is then snapped in place on the end of the shaft 19 opposite the first spindle pulley 20. From this point, the first and second spindle pulleys 20, 22 turn together with the shaft 19, but the cable guides 21, 23 rotate relative to the shaft 19. The cable 74 is constrained to slide within the cable guiding slots 86 of the cable guides 21, 23. This part of the paper loading process is performed with the cable 74 in a slack condition, and preferably with the paper roll 16 resting on the braking spring 36, which extends on a shelf (not shown) forming an intermediate or lower surface within a cabinet below the counter 12. Next, the handle 84 is pulled to tighten the cable 74, lifting the pulleys 20, 22 and thus the paper roll 16, with the pulleys 78 turning together on shaft 79 to help maintain balanced tension in both sides of the cable 74. In this way, the paper roll 16 is lifted by exerting a pulling force equal to about half its weight. The hubs 26 of the pulleys 20, 22 are first brought into alignment with the opening of the slots 30 on each side of the roll mounting bracket 32, as the spindle assembly and paper roll 16 are held in suspension by the cable assembly 38, and are then moved within the slots 30. The manual pulling force provided through the handle 84 is then reduced, so that the hubs 26 drop into the ends 28 of the slots 30. From this point, the weight of the paper supply roll 16 holds the hubs 26 in place.

To facilitate the loading or removal of paper, a top cover 86 of the printer 10 is preferably pivotally mounted to open into the position in which it is indicated by dashed lines 88 in FIG. 2. The drive roll 60 is rotatably mounted to move with the top cover 86, so that it pulls away from the print head 62 into the position indicated by dashed lines 90 in FIG. 2 as the top cover 86 is opened. In this way, the paper web 40 is released from being held within the printer 10. When the upper end of the paper web 40 is released in this way, the weight of tensioning roller 42, already in the lowest position, in which it is shown in FIG. 2, clamps the paper web 40 between the roller 42 and an adjacent surface 92 of the braking spring 36. The inclination of this surface 92 relative to the slot 44 in which the roller 42 moves provides a mechanical advantage causing the paper web 40 to be clamped securely in place. In this way, the paper web 40 is not allowed to fall downward, out of the printer 10 and into the paper supply apparatus 18, from which its retrieval would otherwise be inconvenient.

The braking spring 36 is preferably mounted in a manner allowing it to be slid upward, through the slots 48, 50, 52, when the top cover 86 of the printer 10 is opened as described above. (In FIG. 1, the braking spring 36 is shown below the bracket mounting plate 34 in order to depict its relationship with the paper roll 16, despite the fact that the braking spring 36 cannot be installed from below the bracket mounting plate 34.) The braking spring 36 includes a tab 94 which allows the use of the braking spring to thread the paper web 40 through the apparatus 18.

To use this feature after the paper roll 16 is installed within the paper feed apparatus 18, an outer end of the paper web is folded along a line 96 to form a flap 98, and the paper roll 16 is manually turned to bring the flap 98 of the paper web into engagement with the braking spring 36,extending under the tab 94. Then, with the top cover 86 open, the braking spring 36 is pulled upward, in the direction of arrow 58, with the paper web being also pulled upward in engagement with the braking spring 36 at the tab 94. After flap 98 of the paper web is pulled upward, into the printer 10 in this way, it is disengaged from the braking spring 36, which is then returned downward until its tab 71 rests upon the associated internal surface 72 of the printer 10.

Figure 3:
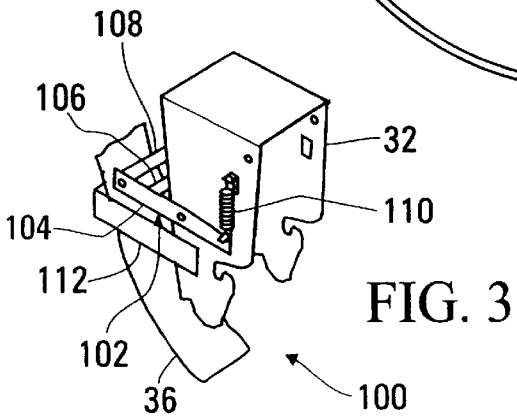
FIG. 3 is an isometric view of an alternative paper tensioning device built in accordance with the present invention.

Referring to FIG. 3, an alternative paper tensioning device, generally indicated as 100, includes tensioning bracket 102 having an arm 104 pivotally mounted to extend from each side of the roll holding bracket 32, with a central portion 106 extending between the arms 104. A tensioning roller 108 is rotatably mounted within the tensioning bracket 102 to extend between the arms 104. The roller 108 is held downward against the paper web 40 by means of an extension spring 110 providing a torque on each of the arms 104. A spring support bracket 112, extending from the roll holding bracket 32, holds the braking spring 36 in place.

While the invention has been shown in its preferred forms or embodiments with some degree of particularity, it is understood that this description has been given only by way of example, and that numerous changes in the details of construction, fabrication, and use, including the combination and arrangement of parts, may be made without departing from the spirit and scope of the invention.

What is claimed is:

1. Paper supply apparatus for a printer having a paper drive moving a paper web through said printer in a paper feeding direction, wherein said paper supply apparatus comprises:

a roll mounting bracket disposed externally from said printer;

a spindle removably and rotatably mounting a paper supply roll to turn freely in said roll mounting bracket;

a tensioning roller applying a tensioning force to a portion of said paper web extending between said paper supply roll mounted on said spindle and said printer; and a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer.

2. The paper supply apparatus of claim 1, wherein said tensioning roller support structure includes a slot on each side of said portion of said paper web extending between said paper supply roll mounted on said spindle and said printer, and a weight of said tensioning roller holds said tensioning roller in contact with said portion of said paper web extending between said paper supply roll mounted on said spindle and said printer.

3. The paper supply apparatus of claim 1, wherein said tensioning roller support structure includes a pivotally mounted bracket, said tensioning roller is rotatably mounted on said pivotally mounted bracket to move along said preferred path with pivoting motion of said pivotally mounted bracket, and said paper supply apparatus additionally comprises a tensioning spring applying a torque to said pivotally mounted bracket to hold said tensioning roller in contact with said portion of said paper web extending between said paper supply roll mounted on said spindle and said printer.

4. Paper supply apparatus for a printer having a paper drive moving a paper web through said printer in a paper feeding direction, wherein said paper supply apparatus comprises:

a roll mounting bracket disposed externally from said printer;

a spindle removably and rotatably mounting a paper supply roll in said roll mounting bracket;

a tensioning roller applying a tensioning force to a portion of said paper web extending between said paper supply roll mounted on said spindle and said printer;

a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer, and a paper web holding surface extending at an oblique angle relative to said preferred path, wherein said tensioning roller clamps said portion of said paper web extending between said paper supply roll mounted on said spindle and said printer against said paper web holding surface when said paper web is released from said paper drive.

5. The paper supply apparatus of claim 1, additionally comprising a braking spring engaging a peripheral surface of said paper supply roll fr stopping rotation of said paper supply roll.

6. The paper supply apparatus of claim 5, wherein said braking spring is formed as a cantilever spring including a first end portion extending to press against a peripheral surface of said paper supply roll.

7. Paper supply apparatus for a printer having a paper drive moving a paper web through said printer in a paper feeding direction, wherein said paper supply apparatus comprises:

a roll mounting bracket disposed externally from said printer;

a spindle removably and rotatably mounting a paper supply roll in said roll mounting bracket;

a tensioning roller applying a tensioning force to a portion of said paper web extending between said paper supply roll mounted on said spindle and said printer;

a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer, a braking spring engaging said paper supply roll for stopping rotation of said paper supply roll, wherein said braking spring is formed as a cantilever spring including a first end portion extending to press against a peripheral surface of said paper supply roll, wherein said braking spring includes an intermediate portion disposed adjacent said tensioning roller at an end of movement of said tensioning roller opposite said first direction, and wherein said intermediate portion extends at an oblique angle relative to said preferred path, and said tensioning roller clamps said portion of said paper web extending between said paper supply roll mounted on said spindle and said printer against said intermediate portion when said paper web is released from said paper drive.

8. The paper supply apparatus of claim 7, wherein said first end portion additionally includes a tab extending to engage a flap extending from an end of a paper web of paper supply roll, and said braking spring is slidably mounted to be pulled into said printer with said tab engaging said flap.

9. Paper supply apparatus for a printer having a paper drive moving a paper web through said printer in a paper feeding direction, wherein said paper supply apparatus comprises:

a roll mounting bracket disposed externally from said printer;

a spindle removably and rotatably mounting a paper supply roll in said roll mounting bracket;

a tensioning roller applying a tensioning force to a portion of said paper web extending between said paper supply roll mounted on said spindle and said printer;

a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer, a braking spring engaging said paper supply roll for stopping rotation of said paper supply roll, wherein said braking spring is formed as a cantilever spring including a first end portion extending to press against a peripheral surface of said paper supply roll, wherein said first end portion additionally includes a tab extending to engage a flap extending from an end of a paper web on said paper supply roll, and wherein said braking spring is slidably mounted to be pulled into said printer with said tab engaging said flap.

10. Paper supply apparatus for a printer having a paper drive moving a paper web through said printer in a paper feeding direction, wherein said paper supply apparatus comprises:

a roll mounting bracket disposed externally from said printer;

a spindle removably and rotatably mounting a paper supply roll in said roll mounting bracket;

a tensioning roller applying a tensioning force to a portion of said paper web extending between said paper supply roll mounted on said spindle and said printer; and a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer and a paper guiding member having a tab extending to engage a flap extending from an end of a paper web of said paper supply roll, wherein said paper guiding member is slidably mounted to be pulled into said printer with said tab engaging said flap.

11. Paper supply apparatus] for a printer having a paper drive moving a paper web through said printer in a paper feeding direction, wherein said paper supply apparatus comprises:

a roll mounting bracket disposed externally from said printer;

a spindle removably and rotatably mounting a paper supply roll in said roll mounting bracket, wherein said spindle includes a shaft having a first pulley attached at a first end of said shaft and a second pulley removably attached at a second end of said shaft;

a tensioning roller applying a tensioning force to a portion of said paper web extending between said paper supply roll mounted on said spindle and said printer;

a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer and a cable extending on each side of said spindle, engaging said first and second pulleys between an anchor point and a handle, wherein said roll mounting bracket includes a slot at each side of said roll mounting bracket into which said spindle is movable while said spindle is held in suspension by said cable.

12. The paper supply apparatus of claim 11, wherein said apparatus additionally comprises a idler pulley rotatably mounted at each side of said roll mounting bracket, and said spindle additionally includes a first cable guide holding a first portion of said cable in alignment with said first pulley and a second cable guide holding a second portion of said cable in alignment with said second pulley.

13. Paper supply roll mounting apparatus for a printer having a paper drive moving a paper web from a paper supply roll through said printer in a paper feeding direction, wherein said paper supply apparatus comprises:

a roll mounting bracket disposed eternally from said printer, wherein said roll mounting bracket includes a slot at each side of said roll mounting bracket;

a spindle for removably and rotatably mounting said paper supply roll in said roll mounting bracket, wherein said spindle includes a shaft having a first pulley attached at a first end of said shaft and a second pulley removably attached at a second end of said shaft; and a cable extending on each side of said spindle, engaging said first and second pulleys between an anchor point and a handle, wherein said spindle is movable into said slot at each side of said roll mounting bracket while said spindle is held in suspension by said cable.

14. The paper supply roll mounting apparatus of claim 13, wherein said apparatus additionally comprises a idler pulley rotatably mounted at each side of said roll mounting bracket, and said spindle additionally includes a first cable guide holding a first portion of said cable in alignment with said first pulley and a second cable guide holding a second portion of said cable in alignment with said second pulley.

15. Printing apparatus comprising:

a printer including a paper drive moving a paper web through said printer in a paper feeding direction as visible markings are formed on said paper web;

a roll mounting bracket disposed externally from said printer;

a spindle removably and rotatably mounting a paper supply roll to turn freely in said roll mounting bracket;

a tensioning roller applying a tensioning force to a portion of said paper web extending between said paper supply roll mounted on said spindle and said printer; and a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer.

16. The printing apparatus of claim 15, additionally comprising a counter having a slot, wherein said printer is disposed above said counter, said roll mounting bracket is disposed below said counter, and said paper web is pulled into said printer through said slot in said counter.

17. Printing apparatus comprising:

a printer including a paper drive moving a paper web through said printer in a paper feeding direction as visible markings are formed on said paper web, wherein said paper drive is disengaged from said paper web to provide access to said paper web;

a roll mounting bracket disposed externally from said printer;

a spindle removably and rotatably mounting a paper supply roll in said roll mounting bracket;

a tensioning roller applying a tensioning force to a portion of said paper web extending between said paper supply roll mounted on said spindle and said printer;

a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer; and a paper web holding surface extending at an oblique angle relative to said preferred path, wherein said tensioning roller clamps said portion of said paper web extending between said paper supply roll mounted on said spindle and said printer against said paper web holding surface when said paper web is released from said paper drive.

18. The printing apparatus of claim 15, additionally comprising a braking spring formed as a cantilever spring including a first end portion extending to press against a peripheral surface of said paper supply roll for stopping rotation of said paper supply roll.

19. Printing apparatus comprising:

a printer including a paper drive moving a paper web through said printer in a paper feeding direction as visible markings are formed on said paper web;

a roll mounting bracket disposed externally from said printer;

a spindle removably and rotatably mounting a paper supply roll in said roll mounting bracket;

a tensioning roller applying a tensioning force to a portion of said paper web extending between said paper supply roll mounted on said spindle and said printer; and a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer; and a braking spring formed as a cantilever spring including a first end portion extending to press against a peripheral surface of said paper supply roll for stopping rotation of said paper supply roll, wherein said first end portion additionally includes a tab extending to engage a flap extending from an end of a paper web on said paper supply roll, and wherein said braking spring is slidably mounted to be pulled into said printer with said tab engaging said flap.

20. Printing apparatus comprising:

a printer including a paper drive moving a paper web through said printer in a paper feeding direction as visible markings are formed on said paper web;

a roll mounting bracket disposed externally from said printer;

a spindle removably and rotatably mounting a paper supply roll in said roll mounting bracket, wherein said spindle includes a shaft having a first pulley attached at a first end of said shaft and a second pulley removably attached at a second end of said shaft, a tensioning roller applying a tensioning force to a portion of said paper web extending between said paper supply roll mounted on said spindle and said printer; and a tensioning roller support structure constraining said tensioning roller to move along a preferred path, wherein said tensioning roller moves along said preferred path in a first direction as said paper roll is accelerated to rotate in an unspooling direction in response to said paper drive starting to move said paper web through said printer, and wherein said tensioning roller moves along said preferred path opposite said first direction as said paper roll is decelerated in response to said paper drive stopping movement of said paper web through said printer; and a cable extending on each side of said spindle, engaging said first and second pulleys between an anchor point and a handle, wherein said roll mounting bracket includes a slot at each side of said roll mounting bracket into which said spindle is movable while said spindle is held in suspension by said cable.

* * * * *